US005584204A

United States Patent [19]

Yoshino

[11] Patent Number: 5,584,204

[45] Date of Patent: Dec. 17, 1996

[54] PRESS PROGRESSIVE DIES FOR A METALLIC GASKET

[75] Inventor: Nobuo Yoshino, Fukushima, Japan

[73] Assignee: Kabushikikaisha Ket & Ket, Nihonmatsu, Japan

[21] Appl. No.: 367,305

[22] PCT Filed: May 6, 1993

[86] PCT No.: PCT/JP93/00595

§ 371 Date: Mar. 16, 1995

§ 102(e) Date: Mar. 16, 1995

[87] PCT Pub. No.: WO94/26508

PCT Pub. Date: Nov. 24, 1994

[51] Int. Cl.[6] ..... B21D 28/14

[52] U.S. Cl. ..... 72/334; 72/336; 72/339; 72/414; 72/404

[58] Field of Search ..... 72/333, 334, 335, 72/338, 339, 414, 415, 389, 404, 336

[56] References Cited

U.S. PATENT DOCUMENTS

| | | | |
|---|---|---|---|
| 2,150,384 | 3/1939 | MacLagan | 72/339 |
| 5,226,306 | 7/1993 | Yoshino | 72/336 |

FOREIGN PATENT DOCUMENTS

| | | | |
|---|---|---|---|
| 1186398 | 8/1959 | France | 72/414 |
| 544613 | 2/1932 | Germany | 72/415 |
| 51-13366 | 2/1976 | Japan . | |
| 52938 | 3/1986 | Japan | 72/324 |
| 61-103627 | 5/1986 | Japan . | |
| 238131 | 10/1991 | Japan | 72/339 |

*Primary Examiner*—Daniel C. Crane

*Attorney, Agent, or Firm*—Jacobson, Price, Holman & Stern, PLLC

[57] ABSTRACT

A press progressive die for a metallic gasket a convex beading die 3 for forming a convex bead 10*b* surrounding a seal part is disposed between a piercing die 2 for a metallic plate and an external shape blanking die 4, characterized in that a plurality of slits 6 having a predetermined width corresponding to a width of a convex member 18 is bored in spaced relation on the convex beading die 3 on the female side along the pressing line opposite to a convex member 18 on the male side provided to press and mold said convex bead 10*b* on a metallic plate which has been subjected to predetermined piercing by mean of said piercing die 2 and progressively fed, and connecting grooves 7 having a depth required to mold a bead by said convex member 18 is bored in the same width as that of the slit 6 between the slits 6. (FIG. 1)

7 Claims, 4 Drawing Sheets

PRESS PROGRESSIVE DIES FOR A METALLIC GASKET

This application is a 371 of PCT/JP93/00595, filed May 6, 1993.

TECHNICAL FIELD

The present invention relates to a die for molding a metallic gasket which is interposed between joining surfaces of a cylinder head and a cylinder block of an internal combustion engine and is fastened by a bolt.

PRIOR ART

As dies for molding a metallic gasket which is interposed between joining surfaces of a cylinder head and a cylinder block of an internal combustion engine and is fastened by a bolt, there have been heretofore developed a die used for a processing method by way of a single step which comprises the steps of piercing and blanking each gasket by means of a single blank piercing die and thereafter beading, and a progressive beading die which comprises piercing, beading and blanking a metallic gasket by way of progressive stamping of a web-like metallic plate.

FIGS. 5(*a*) and 5(*b*) are respectively sectional views showing essential parts of a conventional press progressive beading die. In FIGS. 5(*a*) and 5(*b*), an upper bead in-peripheral base plate 11 is secured to an upper holder 14*a* on the male side, and a convex member 18 having a predetermined pressing line for forming a convex bead is fixedly mounted in the outer periphery of the upper bead peripheral base plate 11 in such a way that the convex member 18 is projected through a predetermined width. Further, a stripper 15 adjusted in height through a stopper 17 is provided in the outer periphery of the convex member 18 in the state where the stripper 15 is resiliently urged in a pressing direction through a spring 22 relative to the upper holder 14*a*.

On the other hand, on a lower holder 14*b* on the female side, a lower bead in-peripheral base plate 12 is fixed internally and a die 16 is fixed externally, boring a slit 19 having a predetermined width according to the pressing line of the convex member 18 on the male side.

These stripper 15 and the die 16 are juxtaposed to a blanking die in the press progressive die. A blanking punch 20 is fixedly mounted on the upper holder 14*a* while being juxtaposed to the stripper 15. The die 16 and the lower holder 14*b* are formed with blanking holes 21 for receiving a blanking punch 20. In the pressing of the blanking punch 20, the blanking punch 20 moves into the blanking hole 21 to provide a predetermined configuration of a metallic gasket in accordance with a boundary line.

In such a convex beading die as described above, in the pressing and molding, the convex member 18 causes a metallic plate 10 to press into the slit 19 to form a convex bead 10*b*.

The lower bead in-peripheral base plate 12 is set to have the same level as the die 16. The upper bead in-peripheral base plate 11 is set to have the same level as the stripper 15. The piercing, the beading and the blanking of the metallic gasket can be subjected to the collective progressive stamping of a web-like metallic plate. At this time, the pressure contact between the pair of upper and lower bead in-peripheral base plates 11 and 12 to press and mold a bead in-peripheral flat plate portion 10*a* of the metallic gasket, the stripper 15 always resiliently keeps the surface pressure between the former and the die 16 by the urging force of the spring 22 to prevent the occurrence of struggle and creases of a bead out-peripheral flat plate portion 10*c* and to press and mold the bead out-peripheral flat plate portion 10*c* as a part of a beading die.

However, in the progressive convex beading die as described above, the die 16 is merely secured in the state independently of the lower die bead base plate 14*b* in a narrow range between the slit 19 and the blanking hole 21, and is always in the state of being short of strength.

In the drawing of the convex bead 10*b*, the convex member 18 presses a bead part of the metallic gasket against the slit 19 in a direction as indicated by the arrow in FIG. 5(*a*). As a result, the width of the slit 19 between the lower bead inperipheral base plate 11 and the die 16 is forced open. For this reason, the die 16 is flexed toward the blanking hole 21. When moving down, the blanking punch 20 comes to contact with the comer of the die 16, resulting in a nicked edge. Or, the die 16 flexed on the side of the blanking hole 21 leads to a poor blanking against the blanking punch 20.

Further, as shown in FIG. 5(*b*), the die 16 is flexed in a direction of the slit 19 as indicated by the arrow by the pressing force of the blanking punch 20. Because of this, the width of the convex bead 10*b* becomes unstable.

SUMMARY OF THE INVENTION

It is an object of the present invention to provide a press progressive die for a metallic gasket, which overcomes a short of strength of a die peculiar to a progressive convex beading die, so as to achieve the smooth press progressive beading.

In the press progressive die for a metallic gasket according to the present invention, a convex beading die for forming a convex bead encircling a seal part is disposed between a piercing die and a blanking die of a metallic plate. A plurality of slits having a predetermined width corresponding to a width of a convex member are bored m spaced relation on a convex beading die on the female side along the pressing line opposite to a convex member on the male side provided to press and mold a convex bead on a metallic plate which has been subjected to predetermined piercing by means of a piercing die. A connecting groove having a depth required to mold a bead by the convex member is bored in the same width as that of the slit between the slits. The top portion of the connecting groove may be formed into a curved angle shape.

On the female side of the beading die, a plurality of slits are partly provided along the pressing line opposite to the convex member on the male side for molding a bead. A connecting groove having a depth required to mold a bead by the convex member is bored between the slim. Thereby, the lower bead in-peripheral base plate and the die are connected integral with each other. The lower bead in-peripheral base plate is fastened to the lower holder by means of a bolt. Then, the lower die is also fastened to the lower holder by a bolt to constitute a rigid structure. The rigidity of the die itself is enhanced. Further, locating of the die is made simultaneously with locating of the lower bead in-peripheral base plate.

When the connecting grooves are formed over the whole periphery of the slits, the dregs tends to stay therein. However, if the connecting grooves are limited to required locations and the tops thereof are formed into the curved angle shape, the dregs can be slipped out of the connecting grooves.

BRIEF DESCRIPTION OF THE DRAWINGS

FIG. 3(*a*) represents the state where slits other than connecting grooves are processed by a wire cutter or the like. FIG. 3(*b*) represents the state where a top of the connecting groove is cut off by a discharge processing or the like. FIG. 3(*c*) represents the state where a top of the connecting groove is cut off into a curved angle shape by a discharge processing. FIG. 3(*d*) shows a section taken along the C1—C1 in FIG. 3(*a*). FIG. 3(*e*) shows a section taken along the C2—C2 in FIG. 3(*b*). FIG. 3(*f*) shows a section taken along the C3—C3 in FIG. 3(*c*).

FIG. 4(*b*) is a sectional view taken along B—B in FIG. 2.

DETAILED DESCRIPTION OF THE EMBODIMENTS

Figure 1:
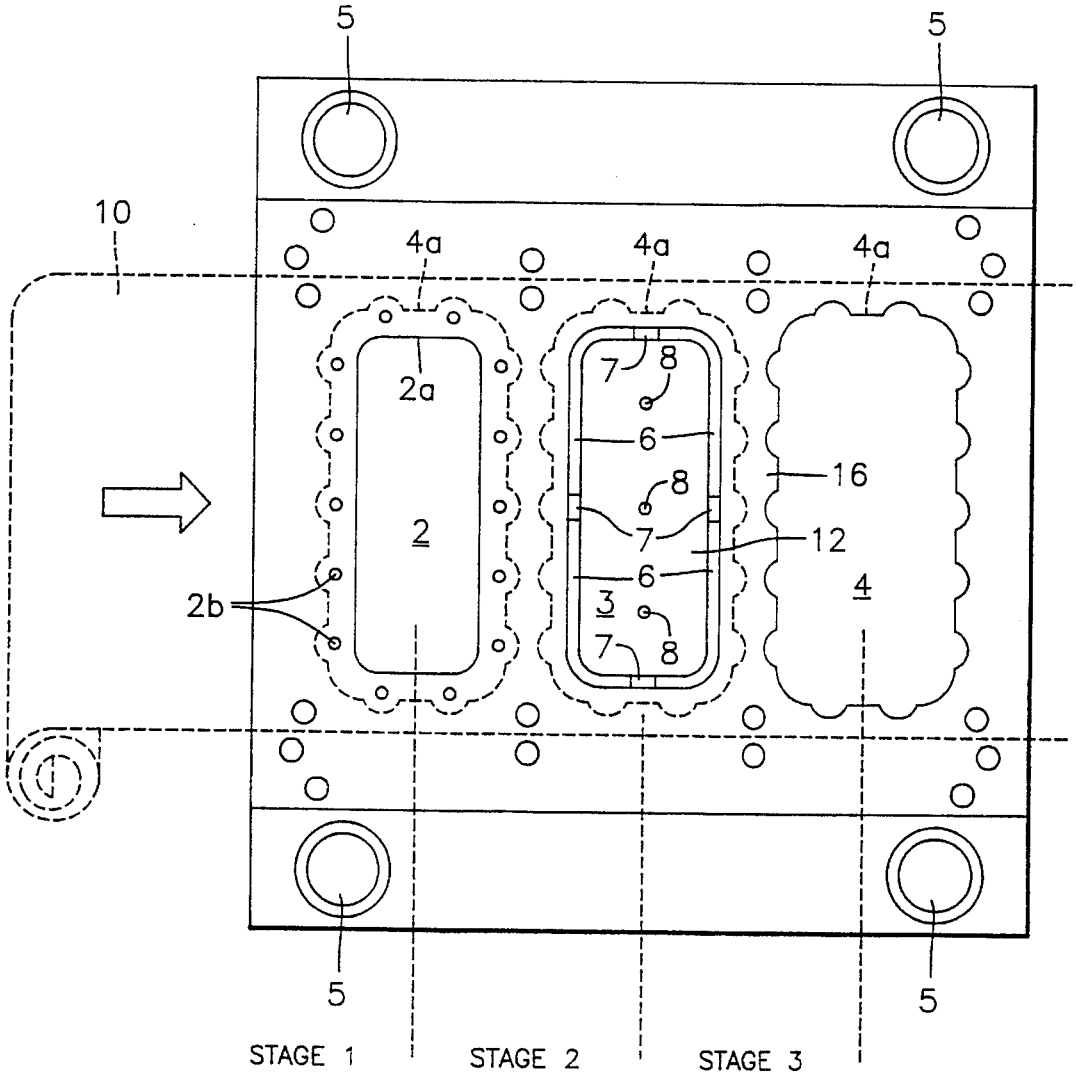
FIG. 1 is a plan view of a female die pressing surface of a press progressive die according to one embodiment of the present invention.
Figure 2:
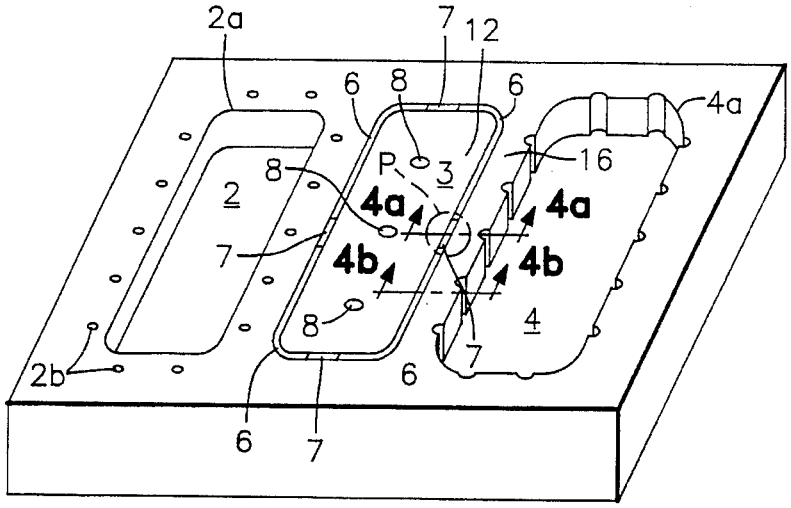
FIG. 2 is a schematic perspective view of the female die shown in FIG. 1.
Figure 3A:
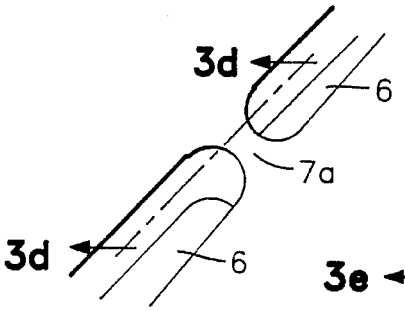
FIGS. 3(*a*) to 3(*b*) are respectively perspective views showing a P portion in FIG. 2 showing a processing method of a beading die according to the present invention.
Figure 3B:
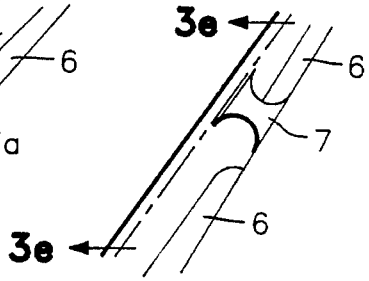
Figure 3C:
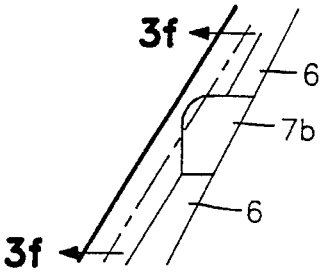
Figure 3D:
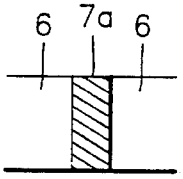
Figure 3E:
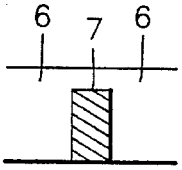
Figure 3F:
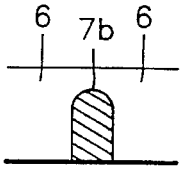

The embodiment of the present invention will be described hereinbelow with reference to the drawings.

The press progressive die has a female die pressing surface 1. A beading die 3 is disposed between a piercing die 2 and a blanking die 4. On four comer portions of the die 3 are disposed guide bushes 5 for guiding a guide post of a male die.

In the piercing die 2, numeral 2*a* denotes a piercing line, and 2*b* denotes a bolt removing hole. In the blanking die 4, numeral 4*a* designates a blanking line.

Figure 4A:
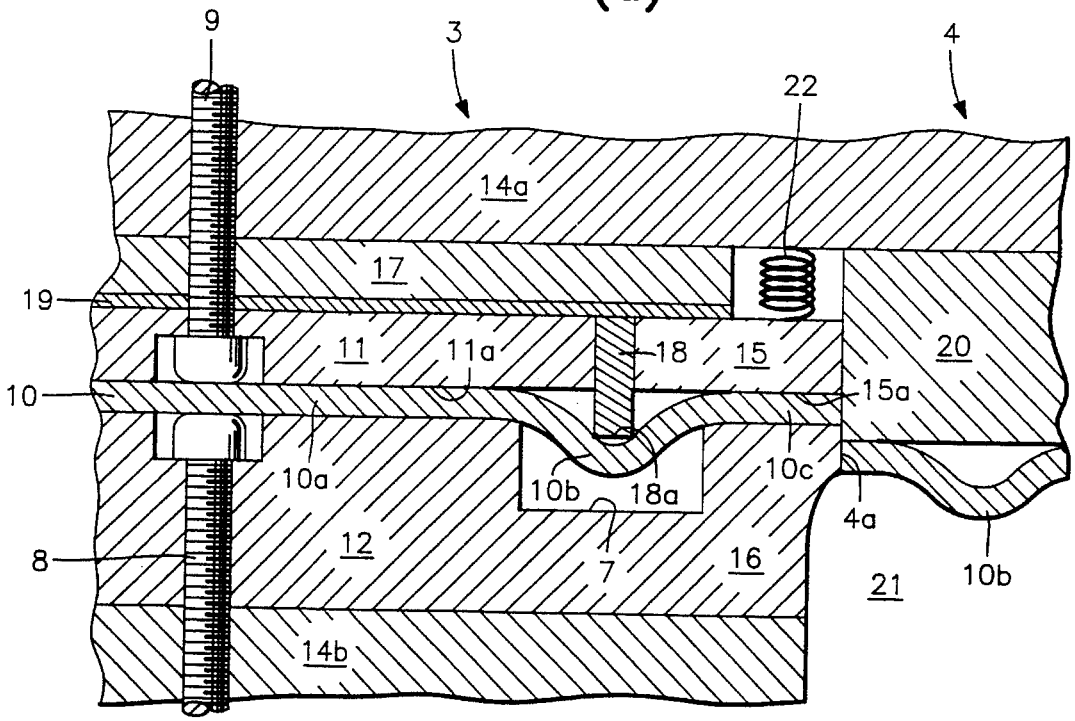
FIG. 4(*a*) is a sectional view taken along A—A in FIG. 2.
Figure 4B:
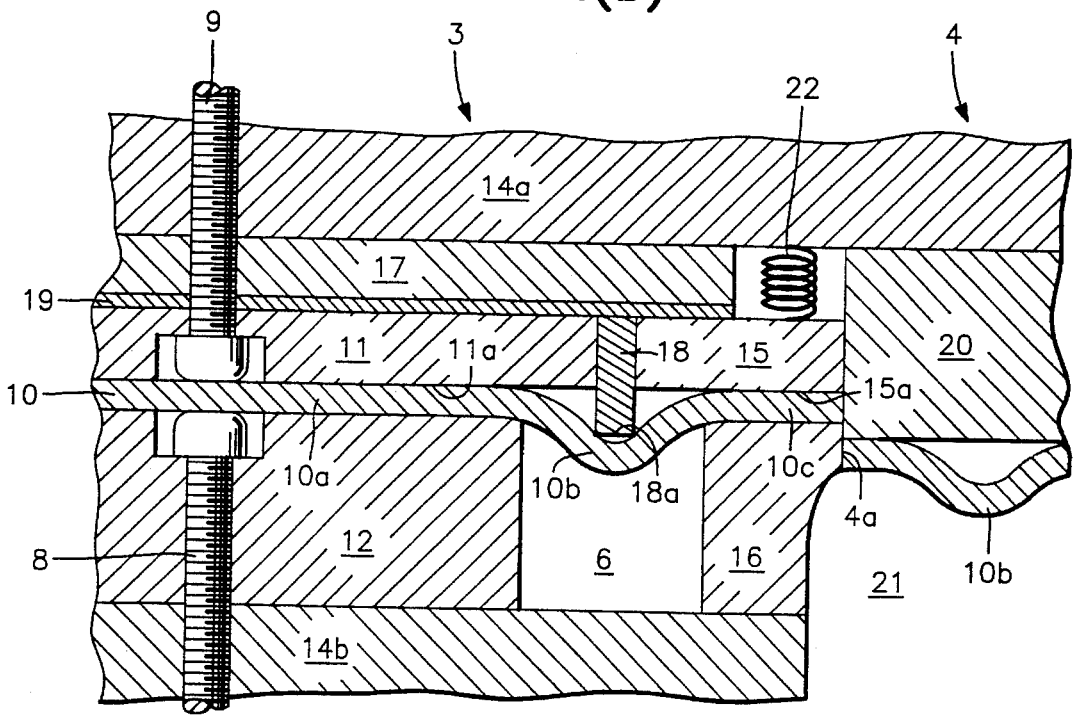
Figure 5A:
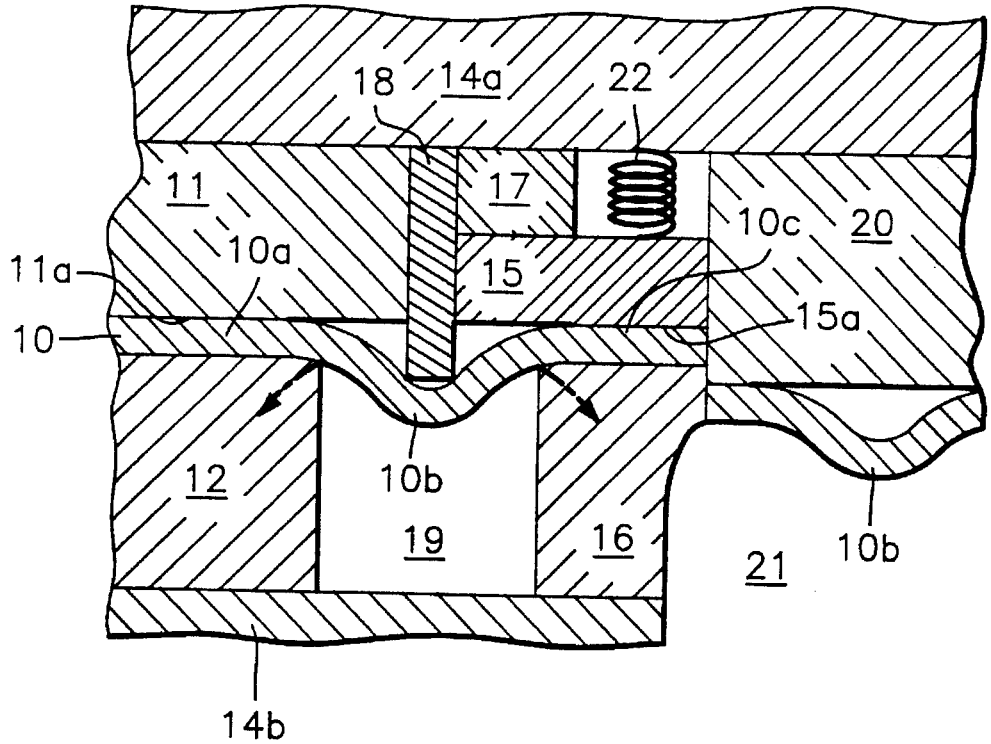
FIGS. 5(*a*) and 5(*b*) are respectively sectional views showing essential parts of the conventional beading die.
Figure 5B:
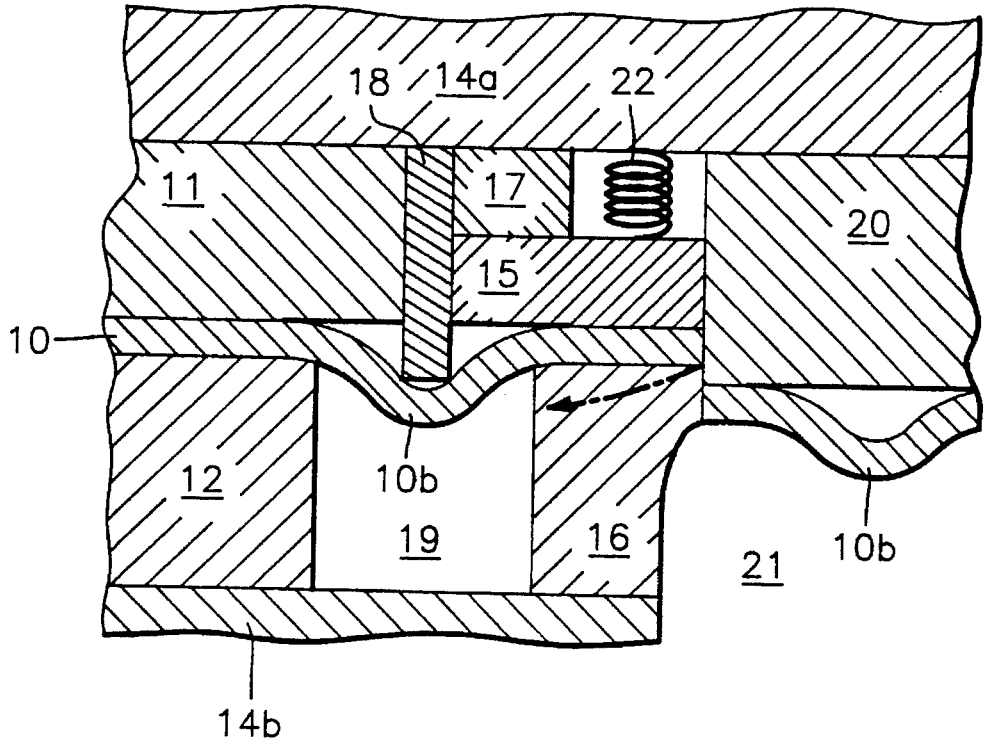

As shown in FIGS. 4(*a*) and 4(*b*), on the male side of the beading die 3 is disposed a convex member 18 according to the molding line of a convex bead 10*b* to be formed in the outer periphery of a pierced metallic plate 10. The convex member 18 is projected to be suspended from a stopper 7 laid on an upper holder 14*a* through a high rigid spacer 19. To the inner periphery of the convex member 18 is secured an upper bead in-peripheral base plate 11 through the spacer 19 and the stopper 17 by means of a bolt 9. A projecting height of the convex member 18 is set to be projected downward by a height of the convex bead 10*b* to be formed from a pressing surface 11*a* of the upper bead in-peripheral base plate 11.

In the outer periphery of the convex member 18 is laid a stripper 15 through a spring 22 suspended from the upper holder 14*a*. The stripper 15 slidably moves vertically relative to the blanking punch 20 of the blanking die 4 and the convex member 18. The stripper 15 is normally urged downward by the force of the spring 22 to place its pressing surface 15*a* above the same level as that of the pressing surface 18*a* of the convex member 18. When the metallic plate 10 is pressed, the stripper 15 is urged upward against the force of the spring 22. When the sapper 15 comes to contact with the stopper 17 through the spacer 19, a pressing surface 15*a* of the stripper 15 assumes the same level as that of the pressing surface 11*a* of the upper bead in-peripheral base plate 11.

On the other hand, on the female side of the beading die 3 are bored a plurality of slits 6, in spaced relation, having a predetermined width, corresponding to a width of the convex member 18 partly along the pressing line on the convex beading die 3 on the female side opposite to the convex member 18 on the male side. A connecting groove 7 having a depth required to mold a bead by the convex member 18 is formed between the slits 7. The connecting grooves 4 are disposed in positions obtained by equally dividing the slits 6 into four portions. However, for example, two connecting grooves 7 may be provided in each long side.

On the female side of the beading die 3 are formed slits 6 according to the width of the convex bead 10*b* having a sectional shape as shown in FIG. 4(*a*) partly according to the pressing line of the convex member 18. The connecting groove 7 has a sectional shape as shown in FIG. 4(*a*). The lower bead in-peripheral base plate 12 and the die 16 are connected integral with each other by the connecting grooves 7. Since the lower bead in-peripheral base plate 12 is secured to the lower holder 14*b* by the bolt 8, the die 16 is also secured to the lower holder 14*b* by locating the lower bead in-peripheral base plate 12.

The processing method for the slit 6 having the connecting groove 7 in the above-mentioned embodiment will be described hereinbelow. As shown in FIGS. 3(*a*) and 3(*b*), a die material subjected to heat treatment and both-sides grinding is first bored with slits 6 by a wire cutter or the like in the state (7*a*) where the connecting grooves 7 are left flat. Next, as shown in FIGS. 3(*a*) and 3(*b*), the top of the connecting groove 7 is shaved off by the discharge processing or the like in consideration of the projecting mount of the convex bead 10*b*. Further, as shown in FIGS. 3(*c*) and (*f*), the top of the connecting groove 7 is formed into a curved angle shape (7*b*) so as to have the shape in which the dregs on the connecting groove 7 are slipped off.

When a resilient metallic plate or a metallic plate 10 having a robber coating applied thereto is progressively fed to a predetermined position and the lower holder 14*b* is moved down, a convex bead 10*b* is formed, in a predetermined bead line, on the metallic plate 10 by the pressing of the convex member 18. An in-peripheral flat plate portion 10*a* of the bead is pressed and formed by the pressure contact between a pair of upper and lowerbead in-peripheral base plates 11 and 12. The stripper 15 always resiliently maintains the surface pressure relative to the die 16 by the urging force of the spring 22. Thereby, the struggle and creases of an out-peripheral flat portion 10*c* of the bead can be prevented from their occurrence. Further, the out-peripheral flat portion 10*c* of the bead is pressed and formed as a part of the beading die.

In the pressing of the blanking punch 20, the blanking punch 20 moves into the blanking hole 21. As a result, a predetermined configuration of a metallic gasket is blanked in accordance with the blanking line 4*a* relative to the die 16.

According to the above-mentioned press progressive die, the die 16 can be connected integrally to the lower bead in-peripheral base plate 12 by the connecting grooves 7 which are disposed in several locations of the slits 6. This improves the rigidity of the die 16. The slit width is also prevented from being forced open. There can overcome a short of strength of the die 16 which has been a problem peculiar to the press progressive die in which the blanking die 4 is provided closely to the convex beading die 3. A further stage has been heretofore provided as a play between stage 2 and stage 3 on the female side of the progressive die (see FIG. 1) in order to obtain the rigidity of the die 16. However, this need not be provided according to the present invention. Accordingly, this is effective in miniaturization of the press progressive die.

Further, the lower bead in-peripheral base plate 12 is fastened to the lower holder 14b by the bolt and at the same time the die 16 is located. Thereby, the locating work and means for the die 16 are not required.

Further, since the connecting grooves 7 are limited to be disposed at locations of the slits 6 as required, the top thereof is formed into a curved angle shape, whereby the dregs can be slipped off from the connecting groove 7.

In case of the progressive die, the hole and internal shape blanking step, the bead forming step and the external shape blanking step are carded out in said order. Due to the presence of the piercing step before the bead forming step, for example, the dregs in the piercing are sometimes abhered to material owing to some conditions. When this the dregs are fed to the beading step, the dregs are fallen into the bead recess groove located in the lower die (on the die side). If this groove is of the overall peripheral type connecting groove, the dregs are stayed in the groove successively. Because of this, scratches tend to occur on the concave head of the bead. However, according to the present invention, the slits and the connecting grooves are employed, and the staying of the dregs through a thickness portion of die material can be avoided. Even if the dregs should be fallen into the partial groove, it would be dropped into the suit due to the presence of the slits and the connecting grooves. Thereby, the above-mentioned trouble can be avoided.

I claim:

1. A female die member for a progressive gasket press, said die member comprising, in sequence, a piercing die for forming the inner periphery of a gasket, a beading die for forming a convex bead around the gasket and a blanking die for forming the outer periphery of the gasket, the beading die including a circumferentially extending beading aperture for receiving a projecting element on a male die member which forms said convex bead, said aperture comprising a plurality of elongate slits in the female die member and grooves between the slits of smaller depth than the slits, said grooves defining portions of the female die member under the grooves which rigidify a part of the female die member between the beading die and the blanking die.

2. A female die member as claimed in claim 1 wherein the slits and the grooves have substantially equal widths.

3. A female die member as claimed in claim 1 wherein the depth of each groove is substantially half the depth of each slit.

4. A female die member as claimed in claim 1 wherein each groove has a curved top portion.

5. A female die member as claimed in claim 1 wherein each groove has an arched top portion.

6. A female die member as claimed in claim 1 wherein each groove has a substantially flat top portion.

7. A female die member as claimed in claim 1 wherein said circumferentially extending aperture is of substantially rectangular shape with four sides and wherein at least one of said grooves is located in each of said sides.

* * * * *